United States Patent [19]

Fontana

[11] Patent Number: 4,545,095

[45] Date of Patent: Oct. 8, 1985

[54] EXTENSIBLE CLASP FOR USE WITH A FLEXIBLE WRISTLET

[75] Inventor: Fernando Fontana, Sesto Calende, Italy

[73] Assignee: Omega SA, Bienne, Switzerland

[21] Appl. No.: 608,339

[22] Filed: May 9, 1984

[30] Foreign Application Priority Data

May 13, 1983 [IT] Italy ..... 21828/83[U]

[51] Int. Cl.[4] ..... A44C 5/24

[52] U.S. Cl. ..... 24/71 J; 24/70 J; 24/265 WS; 24/585; 24/616

[58] Field of Search ..... 24/71 J, 70 J, 116 A, 24/585, 616, 265 WS, 336, 616, 618, 644, 273, 283

[56] References Cited

U.S. PATENT DOCUMENTS

| | | | |
|---|---|---|---|
| 857,197 | 6/1907 | Patterson | 24/273 |
| 1,673,117 | 6/1928 | Kestenman | 24/71 J |
| 1,768,868 | 7/1930 | Tost | 24/71 J |
| 1,966,063 | 7/1934 | Domler | 24/71 J |
| 2,500,649 | 3/1950 | Szeglin | 24/71 J |
| 2,738,561 | 3/1956 | Trilling et al. | 24/585 |
| 3,165,804 | 1/1965 | Marosy | 24/616 |
| 3,521,331 | 7/1970 | Gay | 24/71 J |
| 3,550,216 | 12/1970 | Gandelman | 24/71 J |
| 3,696,469 | 10/1972 | Kalinsky | 24/71 J |
| 3,863,299 | 2/1975 | Hocq | 24/71 J |

FOREIGN PATENT DOCUMENTS

| | | | |
|---|---|---|---|
| 1100923 | 9/1955 | France | 24/585 |
| 352175 | 3/1961 | Switzerland | 24/585 |
| 234990 | 6/1925 | United Kingdom | 24/71 J |

*Primary Examiner*—Victor N. Sakran

*Attorney, Agent, or Firm*—Griffin, Branigan & Butler

[57] ABSTRACT

An extensible clasp is described for use with a watch strap of flat flexible material having at one end a portion formed with a loop fitted with a buckle and at the other end a portion providing apertures for the tongue of the buckle. The clasp comprises first and second elongated portions that are connected by a hinge pin. The outer end of the first elongated portion is pivotally mounted on one of two pins of a link element, the other pin being fitted in said loop after removal of the buckle. The second elongated portion consists of a flattened sleeve into which the apertured end portion of the strap is inserted and secured by a screw. The strap thus becomes continuous and is unlikely to slip off when being fitted round a wrist. To close the clasp, the two elongated portions are folded against each other and a hole near the outer end of the first elongated portion is pressed into locking engagement with a beak element on the second elongated portion. The first elongated portion is resilient and so curved and the hole and beak element are so positioned as to produce a snapping engagement.

7 Claims, 7 Drawing Figures

EXTENSIBLE CLASP FOR USE WITH A FLEXIBLE WRISTLET

BACKGROUND OF THE INVENTION

This invention relates to an extensible clasp for use with a flexible wristlet, e.g. a watch strap of flat flexible material such as leather and plastics.

Most watch straps have at one end a portion formed with a loop fitted with a buckle and at the other end a portion providing apertures for the tongue of the buckle whereby the strap may form a loop of variable length round a wrist.

Such watch straps when being fitted round a wrist are liable to slip away, particularly as the strap has to be fastened with one hand.

SUMMARY OF THE INVENTION

An object of the invention is to provide an extensible clasp that can be fitted to watch straps of the kind set forth to render them continuous, and hence safer, and that can readily be worked with one hand.

According to the invention there is provided an extensible clasp for use with a wristlet of flat flexible material having a first end portion formed with a loop and a second end portion providing at least one aperture, said clasp comprising first and second elongated portions, hinge means for connecting to each other one end of said elongated portions whereby said elongated portions may be folded against each other, means at the opposite end of said first elongated portion for pivotally connecting said first elongated portion to the loop of said first end portion, and means on said second elongated portion for connecting said second end portion to the opposite end of said second elongated portion, said first elongated portion being formed with a hole near said pivotal connection means, said second elongated portion including a flattened sleeve-like member having a pair of spaced apart walls and defining a longitudinally extending passage into which may be inserted at said opposite end of said second elongated portion said second end portion, one of said walls carrying said hinge means and a projecting locking element, having a transverse recess therein, at a distance from said hinge means substantially equal to the distance separating said hinge means from said hole such that when said first elongated portion is folded against said one wall said locking element can be made to penetrate said hole, said recess being engageable with an adjacent edge portion of the hole to lock the clasp, said second elongated portion further including a hole and said connecting means including a peg insertable in said latter hole and through said aperture to secure said second end portion in said passage.

The invention also provides an extensible clasp for use with a flexible wristlet, comprising first and second elongated portions, hinge means for connecting to each other one end of said elongated portion whereby said elongated portions may be folded against each other, and means on said elongated portions for connecting end portions of said wristlet to the opposite end of said elongated portions, said first elongated portion being provided near its opposite end with a projecting locking element having a transverse recess therein and said second elongated portion being formed with a hole at a distance from said hinge means almost equal to the distance separating said hinge means from the locking element, one of said elongated portions being resilient and curved so that when said first and second elongated portions are folded and upon pressure being applied on the resilient portion the curvature of the latter can be reduced to render said distances equal whereby said locking element can be made to penetrate into or moved out of said hole and so that upon release of said pressure after said locking element has penetrated said hole said transverse recess can be made to engage with an adjacent edge portion of said hole to lock the clasp.

DETAILED DESCRIPTION

Figure 1:
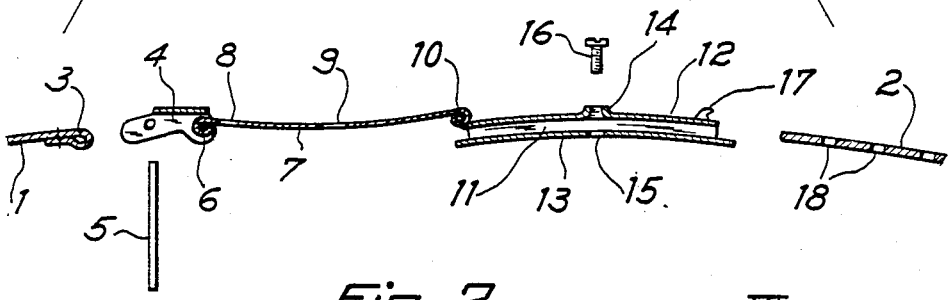
FIG. 1 is a side view in longitudinal section of an extensible clasp embodying the invention, between portions of a flexible watch strap to which it is about to be connected, the clasp being shown in a fully extended position.

The arrangement shown in the drawings comprises two leather or plastics strap portions 1 and 2 that are connected at one end (not shown) to a watch in any suitable manner.

At their other, visible, end, strap portion 1 is formed with a loop 3 (from which a buckle, normally fitted to loop 3, has previously been removed) for connection to one end of ann extensible metal clasp, and strap portion 2 is formed therealong with a plurality of equidistant holes 18.

The clasp comprises a resilient semi-rigid elongated portion 7 and a rigid elongated portion 11 connected to each other, at one end, by a hinge pin 10. At their other end, portion 7 is connected by a hinge pin 6 to a link element 4 which is in turn pivotally connected by a pin 5 to loop 3, and portion 11 is connected by a screw 16 to strap portion 2, with screw 16 extending through one of holes 18.

Figure 2:
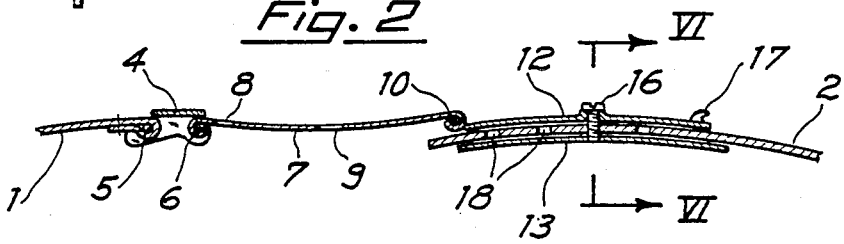
FIG. 2 is a view similar to that of FIG. 1 showing the clasp connected to the adjacent portions of the flexible watch strap.
Figure 3:
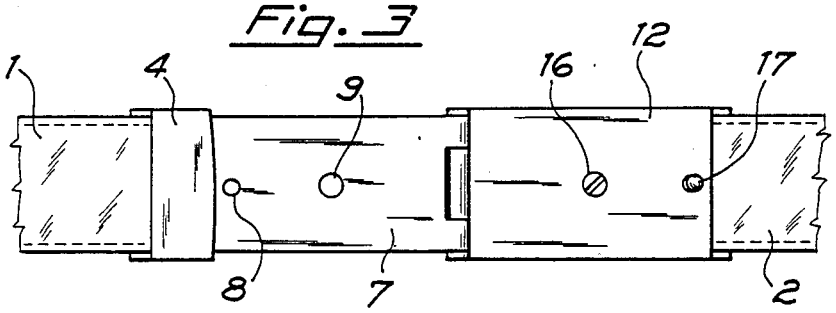
FIG. 3 is a plan view of the assembly shown in FIG. 2.
Figure 6:
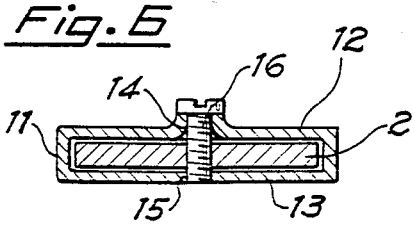
FIG. 6 is a cross-section on an enlarged scale along line VI—VI of FIG. 2.
Figure 7:
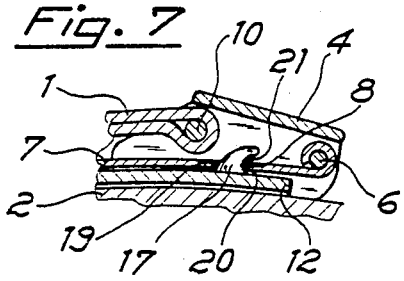
FIG. 7 is a side view in longitudinal section and on an enlarged scale of a detail of FIG. 5, contained in circle VII of FIG. 5.

Clasp portion 11 is slightly curved to conform to the shape of a wrist. Clasp portion 7 is also curved, but slightly more so, and is formed with a central hole 9 and with a hole 8 near pin 6. Clasp portion 11 consists of a flattened sleeve having a pair of facing parallel walls 12 and 13 that are spaced apart a distance such as to allow strap portion 2 to be slidingly inserted in the space between the walls and that are formed with an aligned pair of threaded holes 14 and 15 for receiving screw 16 (FIGS. 2, 3 and 6).

Wall 12, which is slightly shorter than wall 13, carries at one end hinge pin 10 and near its other end a beak element 17. To one side, beak element 17 has a ridge that curves away from pin 10, and, along the other or outer side, it defines a transverse recess 21 behind a hooked tip directed away from pin 10. Recess 21 has a surface to the side of the tip that diverges from wall 12 adjacent element 17.

Figure 4:
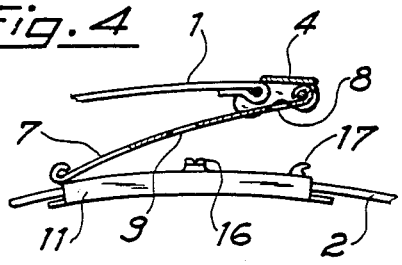
FIG. 4 is a side view of the assembly of FIGS. 2 and 3 with the clasp shown in a position shortly before reaching a closed and locked position and with the clasp shown partly in section.
Figure 5:
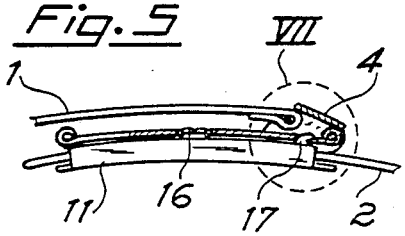
FIG. 5 is a view similar to that of FIG. 4 but showing the clasp in its closed and locked position.

To close and lock the clasp, portion 7 is folded over on to portion 11 as shown in FIGS. 4 and 5. In so doing, hole 9 slips over the head of screw 16 and hole 8 engages over beak element 17. Hole 8 and beak element 17 are so positioned that the outward edge of hole 8 will first abut against the hooked tip of beaked element 17 and will only engage over the hooked tip upon pressure being applied on strap portion 1 in the region of loop 3. The application of pressure causes clasp portion 7 to be compressed and hence straightened, thereby increasing the distance between pin 10 and hole 8 by an amount such that hole 8 will then snap over the hooked tip of beak element 17, the snapping action being aided by the sloping surface beneath the tip. On ceasing to apply pressure, clasp portion 7 resumes its normal curved shape, thereby reducing the distance between pin 10 and hole 8, and the edge of hole 8 engages in recess 21 to lock the clasp.

To open the clasp, a pull is exerted on the end of link element 4 that projects past wall 12 and pressure is applied on strap portion 1 in the region of loop 3. As before the application of pressure on clasp portion 7 increases the distance between pin 10 and hole 8 such as to allow hole 8 to be disengaged from the hooked tip of beak element 17 by the pull exerted on element 4, aided in this by the sloping surface beneath the tip, in a snapping manner.

I claim:

1. An extensible clasp for use with a wristlet of flat flexible material having a first end portion formed with a loop and a second end portion providing at least one aperture, said clasp comprising first and second elongated portions, hinge means for connecting to each other one end of said elongated portions whereby said elongated portions may be folded against each other, means at the opposite end of said first elongated portion for pivotally connecting said first elongated portion to the loop of said first end portion, and means on said second elongated portion for connecting said second end portion to the opposite end of said second elongated portion, said first elongated portion being formed with a hole near said pivotal connection means, said second elongated portion including a flattened sleeve-like member having a pair of spaced apart walls and defining a longitudinally extending passage into which may be inserted at said opposite end of said second elongated portion said second end portion, one of said walls carrying said hinge means and a projecting locking element, having a transverse recess therein, at a distance from said hinge means substantially equal to the distance separating said hinge means from said hole such that when said first elongated portion is folded against said one wall said locking element can be made to penetrate said hole, said recess being engageable with an adjacent edge portion of the hole to lock the clasp, said second elongated portion further including a hole and said connecting means including a peg insertable in said latter hole and through said aperture to secure said second end portion in said passage.

2. A clasp as in claim 1, wherein said pivotal connection means include a link element having a first transverse pin adapted to extend through said loop and a second transverse pin on which said first elongated portion is pivotally mounted.

3. A clasp as in claim 1, wherein said second elongated portion includes for said peg a pair of registering threaded holes in said walls and said peg is a screw.

4. A clasp as in claim 1, wherein said locking element is beak shaped and has along the side thereof nearest said hinge means a ridge curving away from said hinge means, and has formed across the side thereof furthest from said hinge means said recess.

5. A clasp as in claim 1, wherein the recess has a surface remote from said one wall that diverges from the pair of said one wall adjacent the locking element.

6. A clasp as in claim 1, wherein said first elongated portion is resilient and curved.

7. An extensible clasp for use with a flexible wristlet, comprising first and second elongated portions, hinge means for connecting to each other one end of said elongated portions whereby said elongated portions may be folded against each other, and means on said elongated portions for connecting end portions of said wristlet to the opposite end of said elongated portions, said first elongated portion being provided near its opposite end with a projecting locking element having a transverse recess therein and said second elongated portion being formed with a hole at a distance from said hinge means almost equal to the distance separating said hinge means from the locking element, one of said elongated portions being resilient and curved so that when said first and second elongated portions are folded and upon pressure being applied on the resilient portion the curvature of the latter can be reduced to render said distances equal whereby said locking element can be made to penetrate into or moved out of said hole and so that upon release of said pressure after said locking element has penetrated said hole said transverse recess can be made to engage with an adjacent edge portion of said hole to lock the clasp.

* * * * *